United States Patent [19]

Barron et al.

[11] Patent Number: 4,530,111

[45] Date of Patent: Jul. 23, 1985

[54] BODY ARMOR

[75] Inventors: Edward R. Barron, Boston; Abraham L. Lastnik, Framingham, both of Mass.

[73] Assignee: Multi-Tech Corporation, Natick, Mass.

[21] Appl. No.: 527,167

[22] Filed: Aug. 26, 1983

[51] Int. Cl.[3] ..... F41H 1/02

[52] U.S. Cl. ..... 2/2.5; 73/167

[58] Field of Search ..... 2/2.5; 73/167; 89/36 D; 116/203; 156/64; 346/38; 428/43

[56] References Cited

U.S. PATENT DOCUMENTS

| | | | |
|---|---|---|---|
| 3,395,470 | 8/1968 | Voice | 40/2 R |
| 3,633,294 | 1/1972 | Burmeister | 40/2 R |
| 3,973,275 | 8/1976 | Blauer | 2/2.5 |
| 4,079,464 | 3/1978 | Roggin | 2/2.5 |
| 4,413,357 | 11/1983 | Sacks | 2/2.5 |

*Primary Examiner*—Stephen C. Bentley

*Attorney, Agent, or Firm*—Weingarten, Schurgin Gagnebin & Hayes

[57] ABSTRACT

An armored garment, and method for testing an armored garment, wherein a ballistics testing portion is appendant thereto. The testing portion, formed integrally of the armored garment material, may be subjected to ballistic impact, whereupon projectile interception capabilities of the garment may be verified or determined. If desired, the testing portion may be removed without harming the integrity of the garment.

20 Claims, 7 Drawing Figures

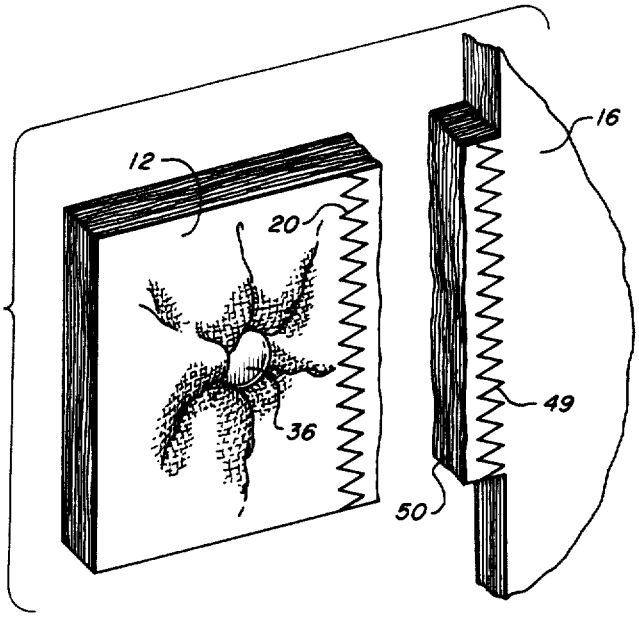
FIG. 6
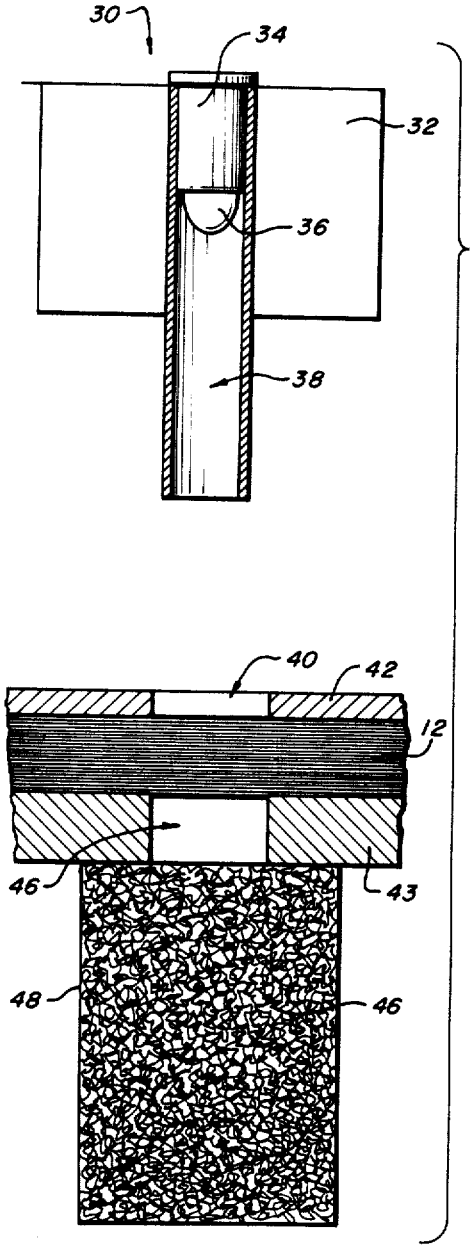
FIG. 5
FIG. 7
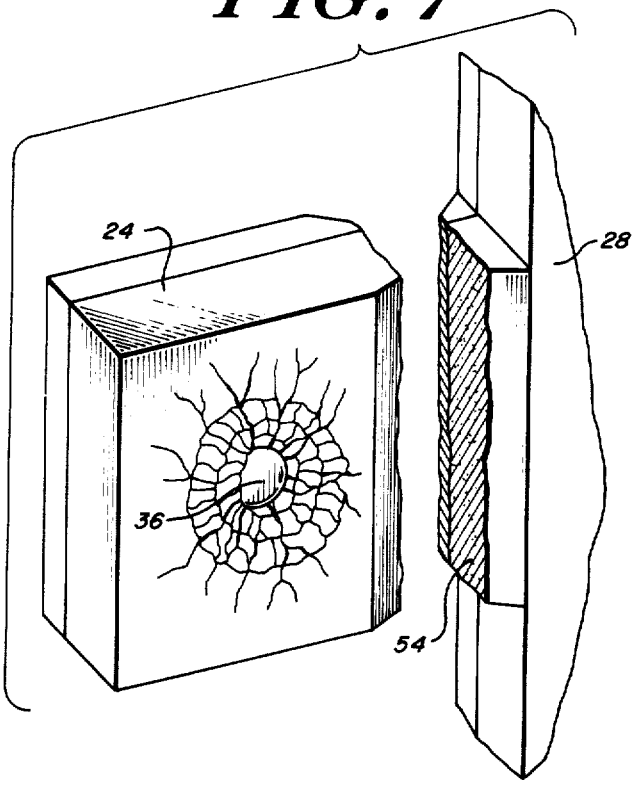

BODY ARMOR

FIELD OF THE INVENTION

The present invention relates to armored garments, and more particularly to an armored garment and method for testing the same, whereby each garment may be individually tested for projectile interception capability, thus providing the purchaser or user thereof with evidence of the utility of the garment for its intended purpose.

BACKGROUND OF THE INVENTION

Due to the nature of armored garments, commonly known as bullet proof vests, it is very desirable to be able to positively ascertain the protective capabilities of such garments prior to use. Typically, an armored garment manufacturer will test a representative sample from a large lot or inventory to obtain a statistical level of confidence with respect to the integrity of untested garments. A test may involve firing a projectile, such as a bullet, into an armored garment. This results in the sacrifice of an expensive garment and produces results which are merely indicative of the probable efficacy of units from that lot. Once an armored garment has been tested, the area of the test can no longer afford proper protection due to the damages sustained. The tested garment is typically subjected to analysis by the manufacturer to understand how the particular garment behaved. The tested garments, however, are not distributed to purchasers or users.

Variations in the manufacturing process, or variations in the nature of the material may result in some garments capable of affording satisfactory protection, and some garments which fail to provide adequate protection. A purchaser or a user who depends upon the armored garment in potentially life threatening situations has no assurance that the garment which he has purchased or wears will provide satisfactory protection. Even if the aforedescribed tests were carried out in the presence of, or under the supervision of the purchasers or users under standardized testing conditions, there is still no reasonable certainty that non-tested garments would provide adequate protection to an ultimate user.

A typical armored garment is disclosed in U.S. Pat. No. 4,079,464. The garment includes front and back panels secured around the torso of a wearer by VELCRO closures. The front and back panels each have an outer cover of synthetic cloth material selectively sewn together to form a plurality of pockets. KEVLAR pads and ballistic shields of KEVLAR and nylon are rigidized with a thermosetting resin and are selectively disposed within pockets in the front and back panels to afford a wearer protection against ballistic impact.

None of the garments known in the art include means for providing one hundred percent testing of the armored garments. Consequently, there is no reasonable certainty that armored garments in use today will provide proper protection against ballistic impact in the event of an attack, until such time as an attack has occurred. Naturally, waiting for an attack in order to be assured that an armored garment will perform under a given set of circumstances is most undesirable. Therefore, a test which will provide a reliable indication of the protective capabilities of an individual garment is greatly needed.

SUMMARY OF THE INVENTION

The present invention provides an armored garment, and method for testing an armored garment, whereby individualized testing may be performed without harming appearance or protective capability of each of the garments.

The present invention provides means for testing one-hundred percent of armored garments manufactured. This is accomplished by the provision of a testing tab which is integal with and formed as a continuous extension of the same material from which the garmemt body is fabricated. The garment may be tested by ballistically impacting the tab, for example by shooting the tab with a predetermined caliber bullet, or impacting the tab with a powerhammer or ram gun. Such a test closely approximates how the actual garment body would perform in use because the tab, being formed as a continuous extension of the material of the garment body, woud behave in an identical manner to the garment body. To provide for maximum user confidence, the garment may be distributed to the purchaser or user with the bullet from the test lodged within the tab. In case the bullet has not lodged itself within the tab, the area of the tab may be enclosed by any suitable means, such as a plastic bag, to maintain the bullet with the tab. In this manner, the purchaser or user may examine the tab and the bullet to understand how the garment will perform, thereby obtaining a level of confidence that the garment is capable of withstanding the impact from such a projectile. After the tab and bullet have been examined, they may be removed if desired to reduce the weight and increase comfort of the garment while being worn.

By use of this method, the invention provides the user with an increased level of confidence through the use of an empirical or objective test. The tab and garment may be made from any of a variety of armored garment materials, including layers of aramid fabric such as KEVLAR or nylon, or ceramic composites such as aluminum oxide or boron-silicon-carbide, which are typically laminated to a resin or fabric backing. It is emphasized that the tab is continuously formed of the same material as the garment body.

Prior to testing of the garment's integrity, the garment is placed on a support surface so that the tab extends over an aperture. A holding device is placed over selected portions of the garment and tab to maintain the garment in position throughout the test. Located directly above the aperture is a device such as a gun, powerhammer, or ramgun which is capable of firing a projectile or actuating a ram so as to impact the tab. Located below the aperture are means for capturing projectiles which may have pierced the garment.

Testing is accomplished by subjecting the tab to ballistic impact in the above-described manner. If the projectile sufficiently damages the garment, the garment may be rejected as failing to meet required protective standards. If the projectile does not pass through the garment and the garment damage is within defined quality standards, the garment will be deemed of sufficient protective capability and prepared for shipment to a purchaser of user.

After testing is complete, the tab may be removed utilizing cutting means appropriate for the type of material from which the armored garment is composed. Cutting means may include an electric or mechanical knife or saw, such as a high speed circular knife. To improve appearance and prevent garment fraying and separation, a double row of stitching is provided on a fabric garment, which delineates the periphery of the garment body from the testing tab. The spacing between rows of stitching is sufficient to permit passage of the cutting means between respective rows. For more rigid garment materials such as ceramic composites, a notch or groove may be provided between the garment body and the testing tab on the backing or armor side of the garment or both. The tab may be removed by breaking the tab from the body along the weakened line. Preferably the tab is located along a straight-edged portion of the garment periphery. This facilitates cutting away of the tab in a fabric garment since it is simpler to cut along a straight line. In a rigid garment, such as a ceramic composite garment, a clean break is more readily achieved if the notch or groove is straight. After removal of the tab from a fabric garment, the cut edge of the garment body may be coated with a flexible resin or cement such as polyvinylbutyral (PVB) and cured by exposure to heat to prevent fraying or separation of respective fabric layers.

DESCRIPTION OF THE DRAWINGS

The invention will be more fully understood from the following detailed description taken in conjunction with the accompanying drawing, in which:

FIG. 5 is a diagrammatic cross-sectional view of testing apparatus showing the armored garment holding means and projectile capturing means;

FIG. 6 is a perspective view of a testing tab of aramid fabric severed from the garment body and illustrating a projectile embedded therein; and FIG. 7 is a perspective view of a testing tab of ceramic composite material which has been broken away from the garment body after projectile impact.

DETAILED DESCRIPTION OF THE INVENTION

Figure 1:
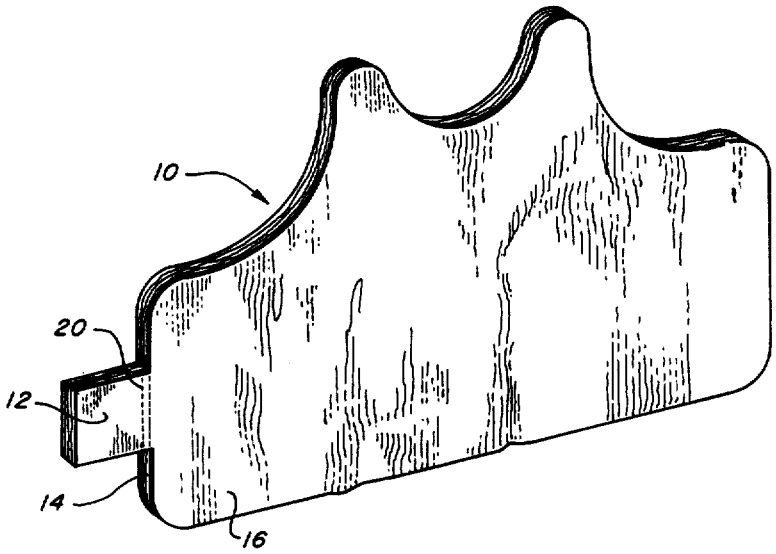
FIG. 1 is a perspective view of an armored garment fabricated from an aramid material showing a testing tab integral with and appendant to the garment body.
Figure 2:
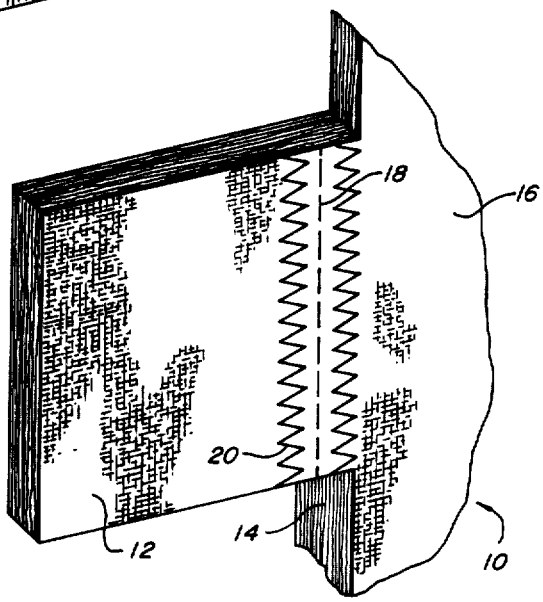
FIG. 2 is an enlarged perspective view of the testing tab of FIG. 1, illustrating the double row of stitches interposed between the body and the testing tab.

Now referring to the figures, the armored fabric garment 10 of the present invention is shown with an integral testing tab 12 appended to and integral with a side 14 of the body 16 of the garment 10. The tab 12 and garment 10 body 16 are shown fabricated from a fabric material, typically including nylon or layers of aramid fabric such as KEVLAR (trademark of Dupont). The line 18 represents a line along which the testing tab 12 may be severed from the body 16. Testing tab 12 may be appendant to other areas of the garment, however, cutting is generally made simpler by locating the tab along a substantially straight portion of the periphery of the garment 10 body 16. Garments of aramid fabric may be made from differing numbers of layers of fabric material, however, the tab, being integral with and continuously formed from the fabric of the body of the armored garment, will necessarily contain the same number of layers as the garment body.

An armored garment of fabric material typically includes plural rows of stitching 20 disposed along a line 18 of demarcation between the garment body 16 and the tab 12. Cutting of the tab from a fabric garment occurs between one of the plural rows of stitching 20. Stitching 20 is made by a suitably modified sewing machine, and is typically in the form of buttonhole stitching, although any suitable stitching pattern may be employed. The stitching is provided to improve the appearance of the garment after cutting away of the tab and to prevent fraying and separation of respective fabric layers. The edge of a garment of fabric material may be coated with a flexible resin or cement such as polyvinylbutyral (PVB), after severance of the tab, and the resin or cement may be cured by exposure to a heat source such as a heat lamp to further prevent fraying or separation of respective fabric layers.

Figure 3:
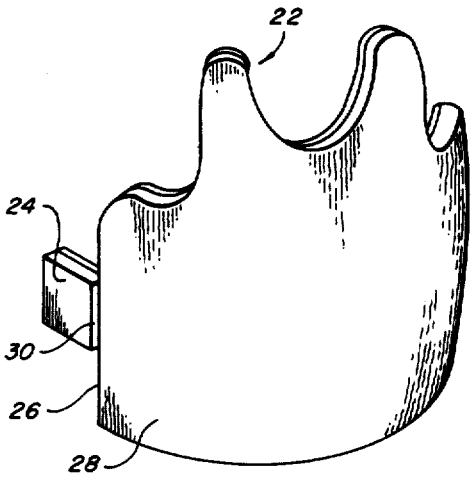
FIG. 3 is a perspective view of an armored garment fabricated from a ceramic composite material and incorporating a testing tab.
Figure 4:
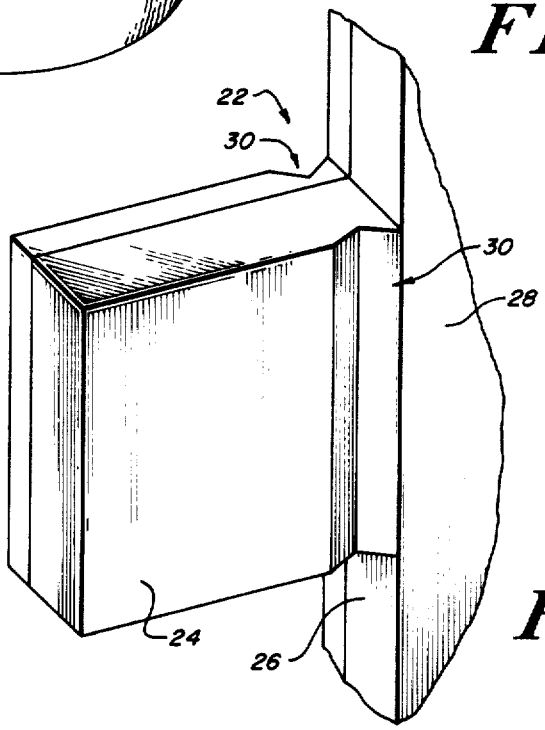
FIG. 4 is an enlarged perspective view of the testing tab of FIG. 3, illustrating the weakened notched portion between the tab and garment body.

With reference now to FIGS. 3 and 4, the ceramic embodiment of the armored garment 22 is shown with an integral testing tab 24 appended to a side 26 of the body 28 of the armored garment 22. Ceramic composite armor is typically laminated to a resinous or fabric backing. Notches or grooves 30 in the testing tab 24 are shown disposed on each side of the tab. The tab 24 may be broken away and cut from the garment body 28 at the weakened point created by the notches 30, and the notches 30 are provided with a depth sufficient to enable quick and easy removal of the tab 24 by striking the tab 24 with a hammer or other suitable implement and cutting the backing along the line of demarcation between the body 28 and the tab 24. A clean break is achieved by locating the tab 24 along a straight edge of the garment body 26. Additionally, notching of the backing material along the line of demarcation avoids the need for subsequent cutting of the backing after breakage of the tab 24 from the ceramic body 26. In FIGS. 3 and 4, the tab 24 is shown disposed along the side 26 of the garment body 28. The ceramic composite garment may be any desired thickness, in accordance with the degree of protection deemed necessary. The tab 24, being integral with the body 28, typically has the same thickness as the body.

With reference now to FIG. 5, projectile firing means 30 is shown wherein the rectangular body 32 represents actuating means for a charge 34 which causes projectile 36, such as a bullet, to travel rapidly down the barrel 38. Not shown is an alternative apparatus comprising a powerhammer or a ram gun, wherein a ram impacts the tab 12. Holding means 42 maintain the testing tab 12 in position on a support surface 43 throughout the test. An aperture 40 is disposed within the holding means 42, permitting the projectile 36 to impact the armored garment testing tab 12. Should the projectile 36 pass through the armored garment testing tab 12, it may safely be captured in absorbent material 44 after passage through a lower aperture 46. Material 44 may be rags, paper, wood, or other suitable material. The material 44 is confined within a metal tube, box, or other suitable enclosure 48, which maintains the material 44 in position under the aperture 46. Naturally, if a bullet or ram passes through the tab, the garment is not distributed with claims of successful testing.

With reference now to FIG. 6, the integral testing tab 12 is shown containing projectile 36. The projectile 36 is shown embedded in the testing tab 12; however, depending on the caliber of projectile 36 and the velocity at which it travels down the barrel 38, the projectile 36 may be only partially embedded or may not have pierced the surface of the testing tab 12 at all. Further, if a powerhammer or a ram gun is used, no projectile is retained in the tab 12. In FIG. 6, the testing tab 12 is shown removed from the body 16 of the garment 10 after having been cut from the body along line 18 between rows of stitching 20 and 49, which define a line of demarcation between the body 16 and the tab 12. Cutting means may include an electric or mechanical knife or saw such as a high-speed circular knife, and will be of an appropriate design for the type and thickness of garment material. The tab 12 may be removed at any time after testing, however, to achieve maximum user confidence the tab is typically removed after it has been viewed by the user. Additionally, the tab and bullet may be enclosed by a suitable retaining means such as a plastic bag, so that the purchaser or user may inspect the bullet and its effect on the tab. Edge 50 is coated with a cement or resin after removal of the tab as described above.

With reference now to FIG. 7, the ceramic composite embodiment of the present invention is shown with testing tab 24 severed from the garment body 28 and having projectile 36 embedded therein. Projectile 36 may not be embedded within the tab 24 after the test if the ceramic composite material has shattered upon impact or if the projectile has fragmented. Additionally, should a powerhammer or ram gun have been used for the test, the ram will typically be withdrawn. Due to the rigid and brittle nature of the ceramic garment 22, the tab 24 is readily severed from the body 28 by breaking away and cutting of the tab 24 from the body 28 along the weakened line of notches or grooves 30. Rough edges 54 may then be worked if desired to provide a smoother surface by any suitable process.

The armored garment and method of testing the garment of the present invention provides a simple accurate test for determining ballistic interception capabilities of individual armored garments. The manufacturer is able to make a one-hundred percent quality check, and the user attains a greater level of confidence regarding the protective capabilities of the garment. Additionally, testing conditions may be standardized; specifically, the caliber and velocity of the projectile may be quantified and data relating thereto presented to the ultimate user.

The above-described invention is illustrative of an armored garment incorporating a testing tab and a method for verifying the integrity of the garment. Other modifications, embodiments, and departures from the present disclosure are possible without departing from the inventive concepts contained herein. Consequently, the invention is to be viewed as embracing each of every novel feature and novel combination of features present in or possessed by the invention herein disclosed, and are to be limited solely by the scope and spirit of the appended claims.

We claim:

1. An armored garment including means for verifying ballistic interception capabilities of the garment comprising:

a garment body of ballistic intercepting material having a peripheral edge;

a tab of said ballistic intercepting material appendant to, integral with, and continuously formed as an extension of the material of said body;

means formed with the garment and intermediate the tab and the body for allowing severing of the tab from the body;

said garment ballistic interception capabilities being verifiable by subjecting the tab to ballistic impact.

2. The garment of claim 1 wherein said garment body and tab comprise layers of aramid fabric material.

3. The garment of claim 2 wherein said aramid fabric material is KEVLAR.

4. The garment of claim 1 wherein said tab depends from said peripheral edge.

5. The garment of claim 4 wherein said means formed with the garment includes at least a row of stitching.

6. The garment of claim 5 wherein said stitching is buttonhole stitching.

7. The garment of claim 1 wherein said garment body and tab comprise a ceramic composite material.

8. The garment of claim 7, further including a fiberglass backing affixed to said body and tab.

9. The garment of claim 7 wherein said means formed with the garment includes a thinner portion of ceramic material intermediate said tab and said body for allowing severance of said tab from said body.

10. An improved armored garment having a body of ballistic interception material, the improvement comprising a tab of said ballistic intercepting material continuously formed, integral with and dependant from said body and means formed with the garment and intermediate the tab and the body for allowing severance of the tab from the body, the ballistic intercepting capability of said garment body being verifiable by ballistic impact on said tab.

11. A method for verifying the integrity of an armored garment comprising the steps of:

providing a tab on the periphery of a garment having a body of ballistic intercepting material, said tab being integral with and continuously formed from the garment body material and dependant from said body;

providing means formed with the garment intermediate the tab and the body for allowing severance of the tab from the body;

subjecting said tab to ballistic impact; and observing whether said ballistic impact pierces said tab.

12. A method for verifying the integrity of an armored garment comprising the steps of:

providing a tab on the periphery of a garment having a body of aramid fabric, said tab being integral with and continuously formed with the garment body fabric and dependent from said body;

ballistically impacting said tab;

observing whether said ballistic impact pierces said tab; and severing said tab from said garment body by cutting said material along a line of demarcation between said tab and said body.

13. A method for verifying the integrity of an armored garment comprising the steps of:

providing a tab on the periphery of a garment having a body of ceramic composite material, said tab being integral with and continuously formed from the garment body material and dependent from said body;

ballistically impacting said tab;

observing whether said ballistic impact pierces said tab; and severing said tab from said garment body by breaking and cutting said material along a line of demarcation between said tab and said body.

14. The method of claim 11 including, after the observing step, the step of:

severing said tab from said garment body.

15. The method of claim 12 including, after the severing step, the step of:

coating the garment body along said demarcation line with a material selected from the group comprising flexible resin and cement.

16. The method of claim 12, further including the steps of:

coating the garment body along said line of demarcation with polyvinylbutyral; and curing said coating by application of heat.

17. The garment of claim 1, wherein said tab depends from a straight edge of said garment body, to facilitate removal of said tab from said garment body.

18. An armored garment including means for verifying ballistic interception capabilities of the garment:

a garment body of ballistic intercepting material having a peripheral edge;

a tab of said ballistic intercepting material appendant to, integral with, and continuously formed as an extension of the material of said body and extending from said peripheral edge;

said garment including plural rows of stitching along a line of demarcation between said body and said tab, said tab being severable from said body by cutting of said material between ones of said rows.

19. The garment of claim 18 wherein said stitching is buttonhole stitching.

20. An armored garment including means for verifying ballistic interception capabilities of the garment comprising:

a garment body of ballistic intercepting material having a peripheral edge;

a tab of said ballistic intercepting material appendant to, integral with, and continuously formed as an extension of the material of said body;

said garment ballistic interception capabilities being verifiable by subjecting the tab to ballistic impact;

wherein said garment body and tab comprise a ceramic composite material and said ceramic composite material is weakened by notching said material along a line of demarcation between said tab and said body to facilitate removal of said tab from said body.

* * * * *